US005809925A

United States Patent [19]

Montgomery

[11] Patent Number: 5,809,925

[45] Date of Patent: Sep. 22, 1998

[54] CHAIN STOPPER

[75] Inventor: James L. Montgomery, Olympia, Wash.

[73] Assignee: Smith Berger Marine, Inc., Seattle, Wash.

[21] Appl. No.: 902,857

[22] Filed: Jul. 30, 1997

[51] Int. Cl.[6] ..... B63B 21/18

[52] U.S. Cl. ..... 114/200

[58] Field of Search ..... 114/200, 210, 114/218; 24/116 R; 294/82.27, 82.3, 82.31

[56] References Cited

U.S. PATENT DOCUMENTS 3,859,946 1/1975 Hammerschlag ..... 114/200

FOREIGN PATENT DOCUMENTS 1118579 10/1984 U.S.S.R. ..... 114/210

*Primary Examiner*—Ed L. Swinehart
*Attorney, Agent, or Firm*—Christensen, O'Connor, Johnson & Kindness PLLC

[57] ABSTRACT

A mooring chain is guided for movement through the frame of a chain stopper along a pair of upright rails, with vertical links of the chain received between the rails and horizontal links of the chain riding on top of the rails. A pawl is swingably mounted on the frame above the rails with inner legs of the pawl engaging a horizontal link of the chain at opposite sides of an adjacent vertical link. The pawl has outer legs which extend downward to a release pin. The release pin has grooves positioned to receive the bottom ends of the outer legs and prevent the pawl from moving in a direction which will allow loosening of the chain, unless the release pin is freed for rotation through an angle of about 90°. The release pin is connected to a trigger assembly including a spinner block which is normally held against rotation by a trigger finger. Movement of the trigger finger frees the spinner block and thereby allows the release pin to move from a pawl-engaging to a pawl-released position. The force of the chain on the inner legs of the pawl swings the pawl automatically as the chain loosens by sliding along the rails. The spinner block rotates freely, with no mechanism restraining it or the release pin.

4 Claims, 6 Drawing Sheets

CHAIN STOPPER

FIELD OF THE INVENTION

The present invention relates to a device for securing a chain, particularly a mooring chain, to an ocean-going vessel, and more specifically to such a device that can be actuated to release the chain even when the chain is under a heavy load.

BACKGROUND OF THE INVENTION

Vessels of the type with which the present invention is concerned often are moored or anchored by large link chains. Such vessels include tankers, floating production storage and offloading vessels (FPSO's), and drilling rigs, for example. Known chain stoppers can be as simple as a frame or fairlead having a track or guideway for the chain and a strong pin insertable to a position for blocking movement of the chain in one or both directions. In another known type of chain stopper, the chain is guided along a track or through a guideway and one or more swingable pawls are provided which can be moved between locking positions, in which movement of the chain in a loosening direction is prevented, and unlocked positions in which the chain is free to move in either a tightening or loosening direction. For example, U.S. Pat. No. 4,889,065 issued to van den Haak shows a chain stopper with a pawl which will ratchet as a chain is hauled in, but which, until released, prevents the chain from being paid out or loosened. U.S. Pat. No. 4,077,348 issued to Broehl shows a different type of chain stopper in which the chain is moved along spaced apart tracks, with pawls at opposite sides for preventing a chain from being paid out unless the pawls are released. In these types of devices, the chain must be hauled in a short distance in order to release the pawls. Conditions can occur, however, when the load on the chain is so great that the chain cannot be hauled in even a short distance by means of available equipment, in which case the vessel may be in danger of damage or even capsizing or sinking.

There have been prior attempts to provide chain stoppers having pawls swung by actuators so that the chain can be released under load. For example, U.S. Pat. No. 3,805,728 issued to Abraham shows a chain stopper in which the chain rides in a rotating windlass with an adjacent swinging pawl moved by hydraulic actuators. U.S. Pat. No. 3,859,946 issued to Hammerschlag discloses a chain stopper having a swingable, double-ended pawl. One end of the pawl is adapted to engage and retain an anchor chain, and the other end of the pawl is adapted to engage a release pin such that the pawl is restrained from swinging unless the release pin is rotated. A hydraulic cylinder also is used to swing the pawl. U.S. Pat. No. 4,186,464 issued to Sandoy discloses still another mechanism for releasing the pawl of a chain stopper under load, consisting of an overcenter or toggle linkage arrangement connected between the pawl and the frame in which the pawl is mounted. Toggle links also have been used to control release pins which can be rotated between pawl-engaged and pawl-releasing positions, similar to the release pin of U.S. Pat. No. 3,859,946.

Known chain stoppers are limited in the load to which they can be subjected and still be power actuated to release a chain without having to haul in the chain.

SUMMARY OF THE INVENTION

The present invention provides a chain stopper of the pawl type, which can be released under a heavy load without damage to the chain stopper or the vessel on which it is mounted. In the preferred embodiment, the mooring chain is guided for movement through the stopper along a pair of upright rails, with vertical links of the chain received between the rails and horizontal links of the chain riding on top of the rails. A pawl is swingably mounted above the rails with inner legs that engage a horizontal link of the chain at opposite sides of an adjacent vertical link. The pawl has outer legs which extend downward to a release pin. The release pin has grooves positioned to receive the bottom ends of the outer legs. The release pin prevents the pawl from moving in a direction which will allow loosening of the chain, unless the release pin is freed for rotation through an angle of about 90°.

The release pin is connected to a spinner block which normally is held against rotation by a trigger finger. Movement of the trigger finger frees the spinner block and thereby allows the release pin to move from a pawl-engaging to a pawl-released position. The force of the chain on the inner legs of the pawl swings the pawl automatically as the chain loosens by sliding along the rails. The spinner block rotates freely, with no mechanism restraining it or the release pin.

The entire construction permits the energy stored in the restrained pawl to be released safely and efficiently, particularly by the free spinning of the release pin and associated spinner block.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a chain stopper for large link chain, which can be released even when the chain is under a heavy load without damage to the chain stopper or the vessel to which it is mounted. For example, prototypes of the present invention have been designed for use with 3¼ inch chain and effectively released at loads of 900,000 lbs. Thus, even in emergency conditions, mooring chains can be let go to free a vessel.

Figure 1:
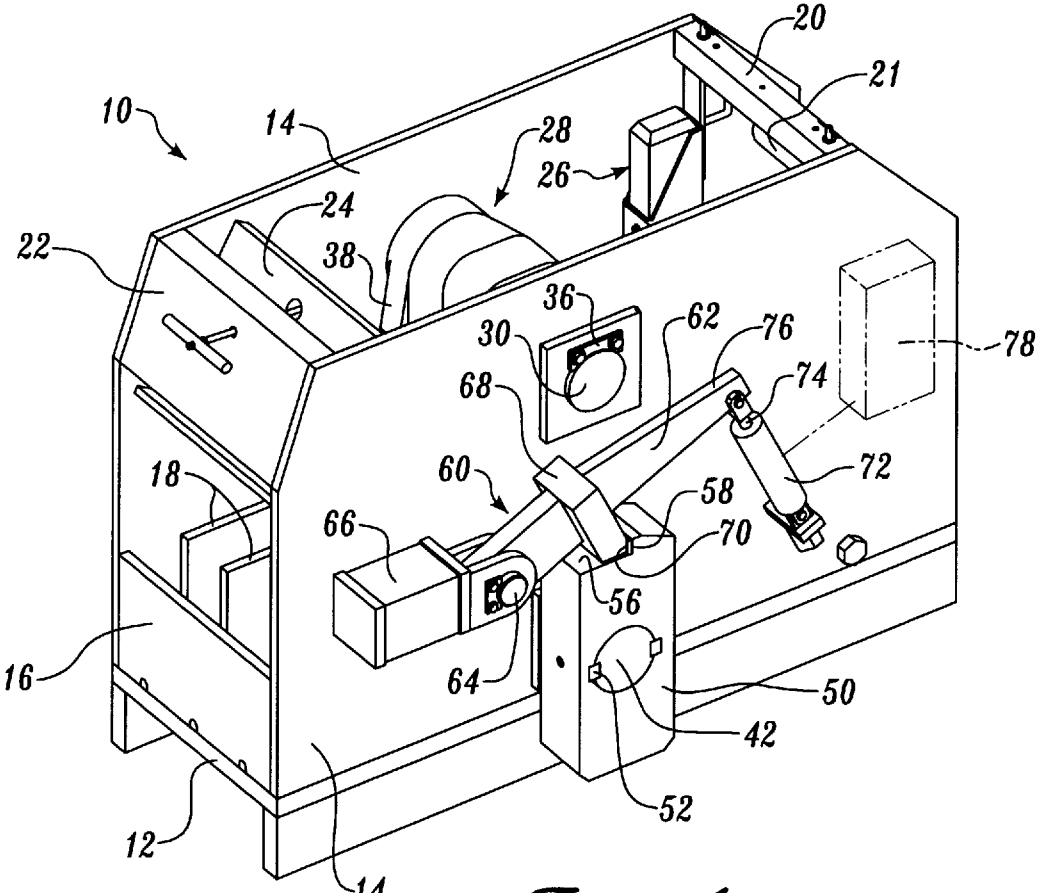
FIG. 1 is a top perspective of a chain stopper in accordance with the present invention.
Figure 2:
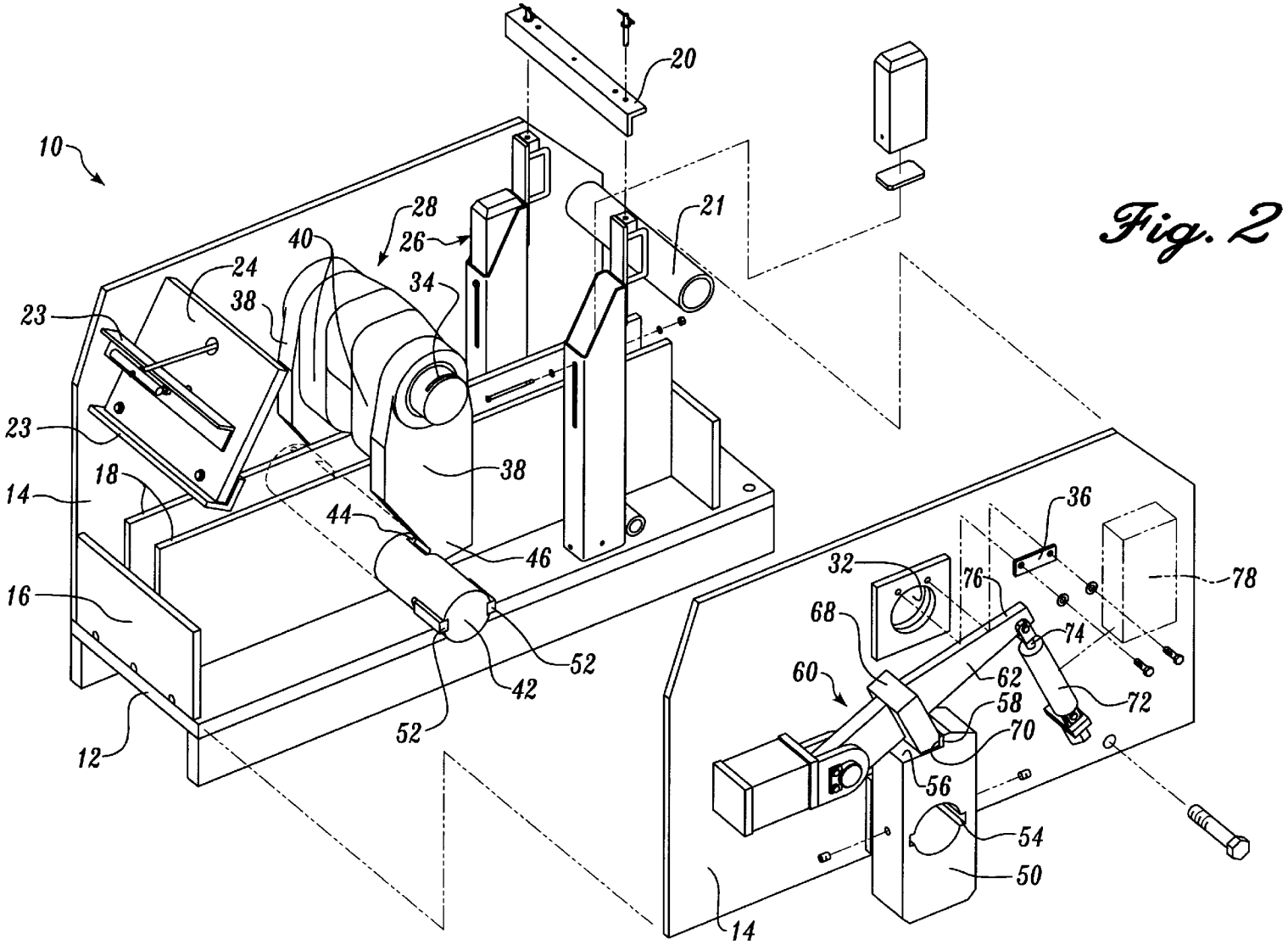
FIG. 2 is a corresponding top perspective with parts shown in exploded relationship.
Figure 3:
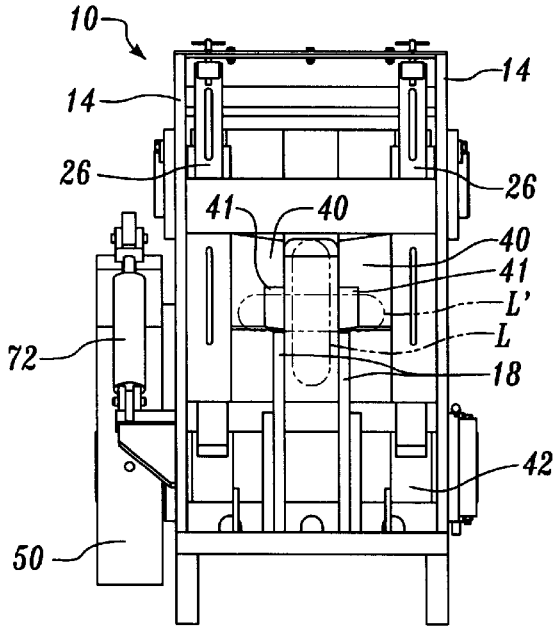
FIG. 3 is an end elevation of the chain stopper of FIG. 1.
Figure 4:
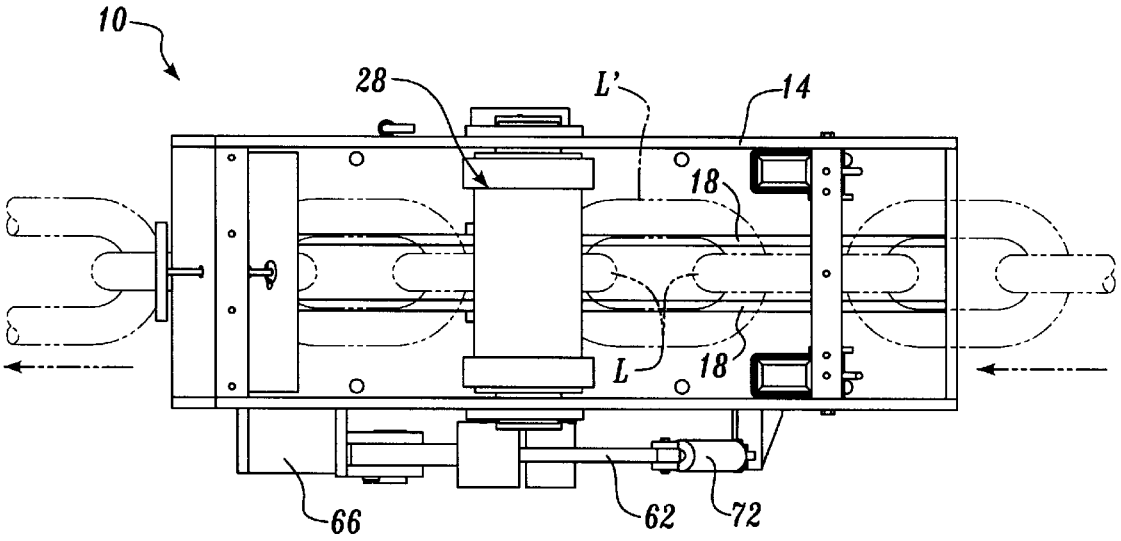
FIG. 4 is a top plan of the chain stopper of FIG. 1.
Figure 5:
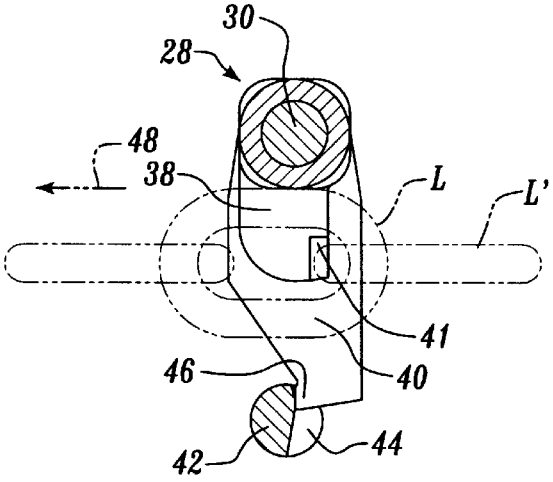
FIGS. 5 through 8 are corresponding, fragmentary, vertical sections through components of the chain stopper of FIG. 1, with parts in different positions.

With reference to FIG. 1 and FIG. 2, the movable components of a chain stopper 10 in accordance with the present invention are mounted in a sturdy frame having a bottom plate 12 and opposite upright side plates 14. Short end plates 16 connect the lower portions of the opposite ends of the side plates. Two long upright rails 18, taller than the end plates, are secured to the bottom and end plates and extend longitudinally of the frame. Such rails are spaced apart a distance substantially greater than the thickness of a link of a size with which the invention is intended to be used, but much less than the width of a link. In the case of 3¼ inch chain, the rails can be spaced apart about five inches. Thus, as seen in FIGS. 3 and 4, the rails form a guide such that the lower portion of a vertical link L will easily ride between the rails, but adjacent horizontal links L' will have their opposite end portions and/or sides resting on the top edges of the rails 18.

Returning to FIGS. 1 and 2, the upper portions of the side plates 14 are connected by a cross beam 20 and a cross tube 21 at one end and an upper end plate 22 (FIG. 1) and cross beams 23 (FIG. 2) at the other. Cross beams 23 support a strike plate or gate 24 described in more detail below. At the opposite end of the frame, two vertical shock absorbers 26 are mounted, also described in more detail below.

As best seen in FIG. 2, chain stopper 10 has a one-piece pawl 28 mounted for swinging about the axis of a pawl axle or pin 30. Pin 30 extends transversely of the frame, above the top edges of the rails 18. The opposite end portions of the pawl pin are journalled in reinforced apertures 32 extending through the side plates 14 about midway between the ends of the side plates. The pawl pin has circumferential grooves 34 in its opposite end portions for receiving retainer plates 36 to prevent transverse movement of the pawl pin in the frame.

Pawl 28 swings freely on the pawl pin 34 about an axis extending transversely of and above the top edges of the rails 18. Preferably, the pawl is formed of one solid piece of metal with long outer legs 38 extending downward adjacent to the side plates 14. The pawl also has shorter inner legs 40 extending closely over the top edges of the rails 18. The distance between the adjacent or inner surfaces of the inner legs 14 is approximately the same as the distance between the rails, such that the upper portion of a vertical link L of the chain guided between the rails will easily fit between the inner legs 40, as seen in FIG. 3. The outer legs 38 are spaced apart a distance greater than the maximum width of a chain link, such that horizontal links L' riding along the rails fit between the inner surfaces of the outer legs. However, a horizontal link L' cannot pass between the inner legs 40 unless the pawl is rotated. As best seen in FIG. 3, the inner legs have beveled surfaces 41 forming shallow sockets to receive the leading end of a horizontal link L'. This helps to center the link over the rails 18, and to prevent the leading end of the link from being raised relative to the pawl, and to essentially balance the applied force between the inner legs 40.

A release pin 42 is rotatably mounted in the frame, preferably substantially directly below the pawl pin 30. The release pin is freely rotatable in bearings carried by the side plates 14. The release pin is formed with transverse grooves 44 positioned to register with the bottom end portions of the outer legs 38 of the pawl. If the release pin is retained with the grooves 44 extending vertically, the bottom end portions of the pawl legs 38 engage within the grooves, and the pawl cannot swing in a direction that would permit paying out or loosening of the chain. However, the parts are proportioned such that if the release pin is rotated one-quarter turn, the pawl will rotate and thereby release a chain guided on the rails 18.

More specifically, FIGS. 5 through 8 show the relationship between the pawl 28 including its outer legs 3 8 and inner legs 40, and chain L, L'. The chain is guided by the rails 18 (not seen in FIGS. 5 through 8) with the bottom portions of the vertical links L received between the rails and the horizontal links L' riding on top of the rails. The leading edge of a horizontal link L' engages in the sockets 41 of the inner legs 40. The bottom ends 46 of the outer legs 38 normally engage in the grooves 44 of the release pin 42. Force typically is applied to the chain in the direction of the arrows 48, i.e., the arrows indicate the direction of movement to pay out or loosen the chain. Since the pawl 28 is freely rotatable on the pawl pin 30, the chain can be tightened by hauling it in the opposite direction, in which case the pawl would rotate counterclockwise sufficiently to allow horizontal links to pass beneath the inner legs 40. So long as the release pin 42 is held in the position indicated in FIG. 5, the pawl cannot rotate in a clockwise direction so as to permit loosening of the chain.

Figure 6:
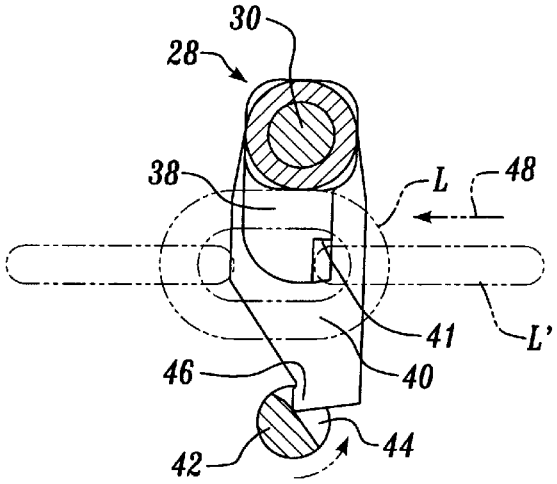
Figure 7:
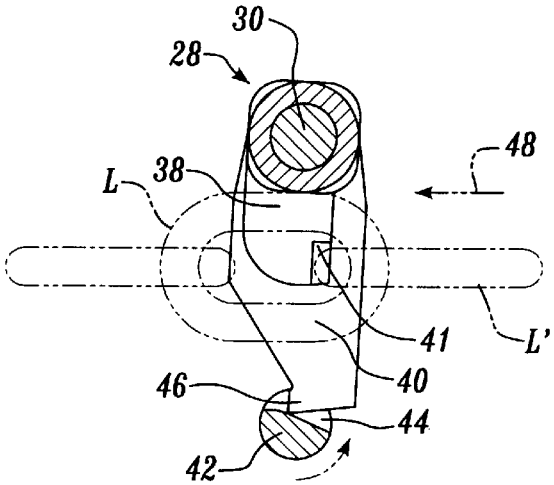
Figure 8:
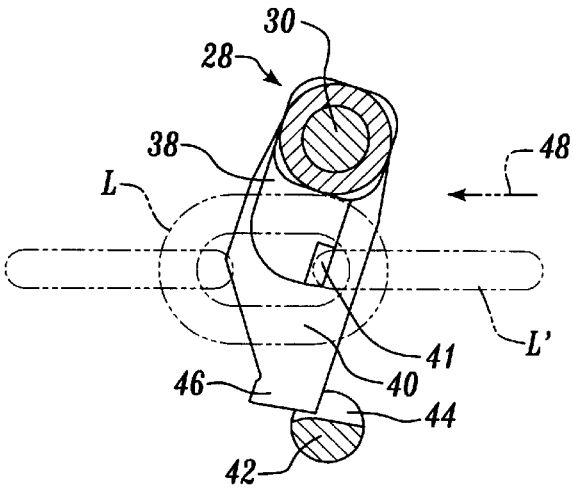

FIGS. 6 through 8 illustrate the sequence if the release pin is permitted to rotate. The release pin and pawl are constructed and arranged relatively such that force applied to the pawl by the chain is transmitted to the release pin at a point above its center of rotation. Thus the release pin rotates through the position of FIGS. 6 and 7, to the position of FIG. 8 in which the groove 44 is oriented essentially horizontally. The force applied by the chain throws the pawl to the left as viewed in FIGS. 5 through 8, such that the bottom ends 46 of the outer pawl legs 38 are no longer retained by the release pin. The pawl rotates clockwise and, as discussed below, is retained in a released position in which it does not interfere with loosening of the chain.

As thus far described, the mechanism is similar to prior art chain stoppers. Such prior art stoppers, however, provided a toggle link mechanism for retaining and releasing the release pin, and were not effective under loads of the strength with which the present invention is concerned (i.e., up to about 900,000 lbs.). The present invention is an improvement upon such prior art chain stoppers primarily in the mechanism for retaining the release pin and for safely releasing it in a manner that the tremendous energy stored in the tightened chain configuration can be discharged.

With reference to FIG. 1 and FIG. 2, one end portion of the release pin 42 extends through a side plate 14 and is retained in a large spinner block 50. Such projecting end portion has keys 52 cooperating with keyways 54 of the spinner block so that the spinner block cannot rotate relative to the release pin. The spinner block is a single rectangular block of metal which normally is oriented vertically. The upper end portion of the spinner block has a notch forming a horizontal shoulder 56 and an upright abutment face reinforced by a replaceable strike plate 58.

The spinner block is one component of a trigger assembly 60 that includes an upward and rearward inclined trigger arm 62 which is mounted for swinging about its leading end portion by a trigger pin 64. Pin 64 is carried in a mounting block assembly 66 which, in turn, is secured to the side plate 14 in front of the spinner block 50. The trigger arm 62 carries a finger 68 which extends transversely to the length of the arm and has a bottom end portion with an abutment face 70 normally engaged in the notch of the spinner. More specifically, the abutment face 70 normally engages the strike plate 58 of the spinner, thereby preventing rotation of the spinner which would allow the release pin 42 to rotate in a counter-clockwise direction. Preferably, the engaged abutment surfaces of the strike plate and the trigger finger meet at a plane which, if extended, would intersect the rotational axis of the release pin and spinner block. Thus, the trigger finger can be moved upward without appreciably moving the spinner block, but still is normally retained in the engaged position by the force tending to rotate the block clockwise, as a result of the force of the chain on the pawl.

Figure 9:
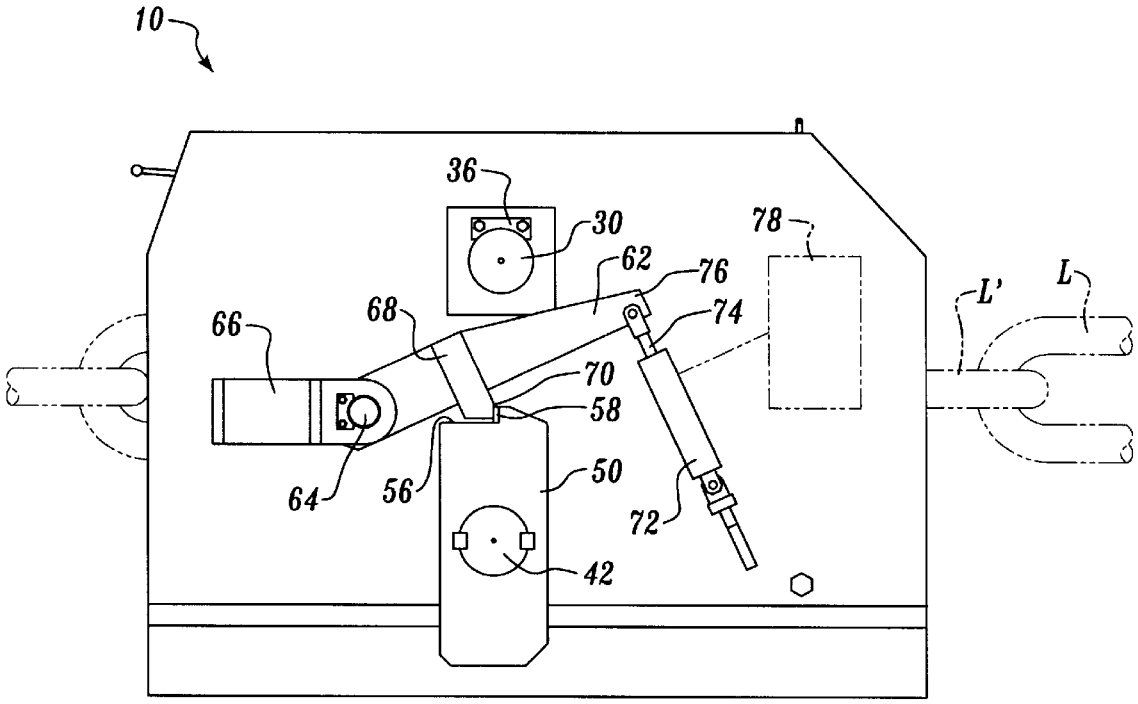
FIG. 9 and FIG. 10 are corresponding side elevations of the chain stopper of FIG. 1, with parts in different positions.
Figure 10:
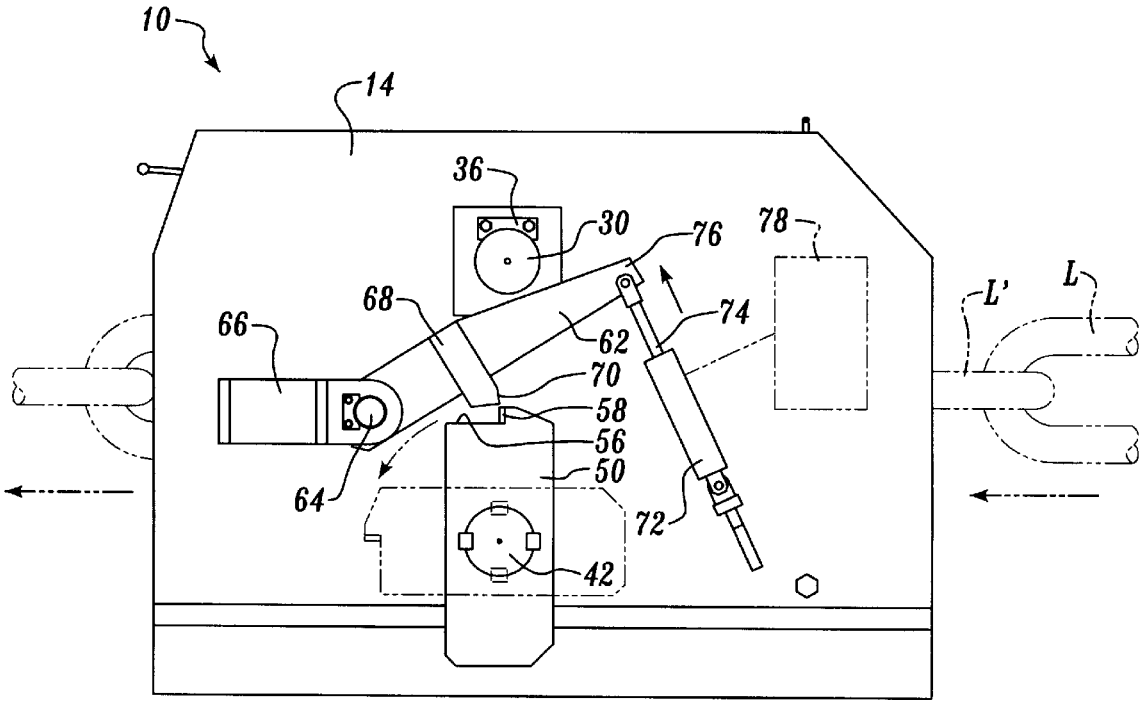
Figure 11:
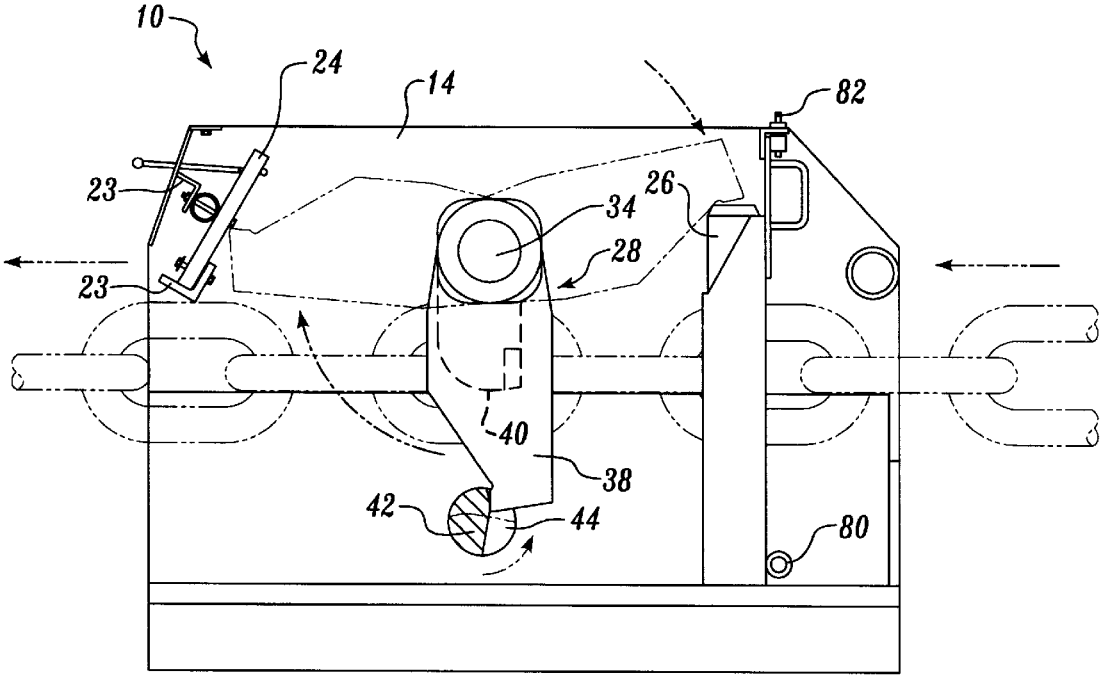
FIG. 11 and FIG. 12 are corresponding side elevations of the chain stopper of FIG. 1, with parts removed and parts in different positions.

A fluid pressure actuator 72 is mounted to the side plate 14 with a plunger rod 74 pivotally connected to the swinging end 76 of the trigger arm 62. Extension of the plunger 74 has the effect of swinging the trigger arm upward, from the position shown in FIG. 9 to the position shown in FIG. 10. Operating fluid for the actuator 72 preferably is supplied by a control system 78, including an accumulator and a remote controlled valve. Actuation of the valve quickly extends the plunger rod 74 to raise the trigger arm 62 and thereby disengage the abutting faces of the trigger finger 68 and the spinner block 50. Referring to FIG. 5 through 8, releasing the spinner block allows the release pin 42 to turn, such that the pawl immediately swings past the release pin. With reference to FIG. 11, in rapid succession the pawl swings past pin 42, to the leftward extending broken line position of FIG. 11 illustrating the pawl striking the gate 24 which is resiliently and pivotally mounted on the forward cross beams 22 and 23. Because of the tremendous force being released, the pawl typically will swing past the gate to the rightward extending broken line position illustrating the outer legs of the pawl striking the vertical shock absorbers 26. The shock absorbers are designed with maintenance free energy-absorbing members capable of absorbing the energy created by the release of the chain without damage to the mounting. The pawl will typically rebound from the shock absorber, rotating back against the gate 24 and then forward to rest against the shock absorbers 26 as shown in solid lines in FIG. 12. Thus some of the energy imparted by the chain release to the pawl is absorbed by the rotation of the pawl while a larger portion of that release energy is absorbed by the shock absorbers.

Energy is also transmitted to the release mechanism by the pawl. This is a substantial amount of energy which would normally require a second set of shock absorbers; however, the preferred design allows the release pin 42 and spinner block 50 to rotate freely so that this energy is harmlessly absorbed by the spinning of these components with no stop to prevent the free rotation of the release pin 42 and spinner block 50. With the trigger arm 62 retained in its raised position (FIG. 10), there is nothing to prevent the release pin 42 and spinner block 50 from rotating, such that the release pin and spinner block spin at high speed with nothing to slow them other than frictional forces of the spinner pin based on its mounting in the side plates 14. The speed of rotation gradually decreases. This is in sharp contrast to known constructions in which the release pin is retained in one position or the other, such that the actuating mechanism must withstand the high forces applied to the release pin when it is moved from the pawl-retaining position to the pawl-released position. The trigger arm acts at 90° to the force of the spinner block and does not require any energy absorption.

Figure 12:
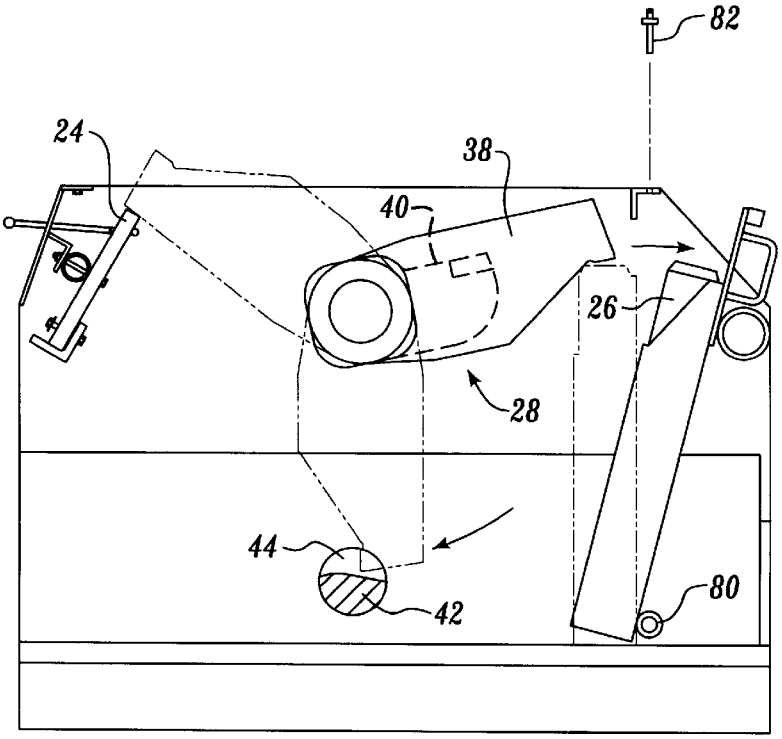

With reference to FIG. 12, preferably the shock absorbers 26 are pivotally mounted to the frame by pins 80 located toward the bottom ends of the shock absorbers. The shock absorbers normally are retained in an upright position by a locking mechanism including lock pins 82 at the top. Such lock pins normally connect the tops of the shock absorber assemblies to the cross bar 20. With the lock pins removed, the shock absorbers can be swung rearward to the solid line position shown in FIG. 12. The pawl 28 then can be swung clockwise back to the vertical position shown in broken lines in FIG. 12. The release pin 42 is rotated to the pawl-retaining position by movement of the spinner block 50 to the vertical orientation shown in FIG. 9, and the plunger rod 74 of the actuator 72 is retracted to reengage the abutment surfaces of the trigger finger 68 with the strike plate 58 of the spinner block. The chain stopper then is in condition for again receiving the mooring chain L, L'.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A stopper for retaining a chain comprising:

a frame having means for receiving a chain and for guiding the chain for movement lengthwise relative to the frame in a chain-loosening direction and in a chain-tightening direction;

a pawl mounted in the frame for movement between a chain-engaged position in which the chain is blocked from movement in the chain-loosening direction and a chain-released position in which the chain is free to move;

a release pin mounted in the frame and rotatable between a pawl-released position in which the pawl is free to move and a pawl-engaged position for retaining the pawl in the chain-engaged position to prevent movement of the chain in a loosening direction, the guide means, pawl and release pin being constructed and arranged relatively such that, when the pawl is in the chain-engaged position and the release pin is in the pawl-engaged position, force applied to the chain in the chain-loosening direction is transferred through the pawl to the release pin and biases the release pin toward the pawl-released position; and a trigger assembly normally retaining the release pin in the pawl-engaged position but actuatable to permit free rotation of the release pin to and beyond the pawl-released position for discharge of energy by free spinning of the release pin.

2. The stopper defined in claim 1, in which the trigger assembly includes a spinner block mounted on the release pin for rotation therewith and having a first abutment face, a trigger arm mounted on the frame and having a finger including a second abutment face interengagable with the first abutment face to retain the release pin in the pawl-engaged position, and an actuator for moving the trigger arm to disengage the second abutment face from the first abutment face and thereby release the release pin to enable swinging of the release pin to and beyond the pawl-released position.

3. The stopper defined in claim 2, in which the first and second abutment faces are substantially planar and extend substantially radially with respect to the axis of rotation of the release pin when interengaged.

4. A stopper for retaining a chain comprising:

a frame having a guide for receiving a chain and for guiding the chain for movement lengthwise relative to the frame in a chain-loosening direction and in a chain-tightening direction;

a pawl mounted in the frame for movement between a chain-engaged position in which the chain is blocked from movement in the chain-loosening direction and a chain-released position in which the chain is free to move;

a release pin mounted in the frame and rotatable between a pawl-released position in which the pawl is free to move and a pawl-engaged position for retaining the pawl in the chain-engaged position to prevent movement of the chain in a loosening direction, the guide, pawl and release pin being constructed and arranged relatively such that, when the pawl is in the chain-engaged position and the release pin is in the pawl-engaged position, force applied to the chain in the chain-loosening direction is transferred through the pawl to the release pin and biases the release pin toward the pawl-released position; and a trigger assembly normally retaining the release pin in the pawl-engaged position but actuatable to permit free rotation of the release pin to and beyond the pawl-released position with no stop to prevent the free rotation for discharge of energy by free spinning of the release pin.

* * * * *